US008670690B2

(12) United States Patent
Jang et al.

(10) Patent No.: US 8,670,690 B2
(45) Date of Patent: Mar. 11, 2014

(54) PROCESS CARTRIDGE AND IMAGE FORMING APPARATUS HAVING THE SAME

(75) Inventors: Ho Jin Jang, Suwon-si (KR); Joo Hwan Noh, Yongin-si (KR); Yun Kyu Sim, Suwon-si (KR); Sung Han Kim, Suwon-si (KR); Ji Won Moon, Anyang-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 86 days.

(21) Appl. No.: 13/344,028

(22) Filed: Jan. 5, 2012

(65) Prior Publication Data

US 2012/0177400 A1 Jul. 12, 2012

(30) Foreign Application Priority Data

Jan. 6, 2011 (KR) ..... 10-2011-0001294

(51) Int. Cl.
*G03G 21/18* (2006.01)

(52) U.S. Cl.
USPC ..... 399/111; 399/119; 399/120

(58) Field of Classification Search
USPC ..... 399/111, 115, 168
See application file for complete search history.

(56) References Cited

U.S. PATENT DOCUMENTS 6,144,398 A * 11/2000 Yokoyama et al. ..... 347/263
2011/0150526 A1* 6/2011 Sasaki et al. ..... 399/111

FOREIGN PATENT DOCUMENTS

JP 2006-276190 * 10/2006 ..... G03G 21/18

* cited by examiner

*Primary Examiner* — Clayton E LaBalle
*Assistant Examiner* — Kevin Butler
(74) *Attorney, Agent, or Firm* — Staas & Halsey LLP

(57) ABSTRACT

An image forming apparatus includes a photoconductor unit, a developing unit to feed a developer to a photoconductor of the photoconductor unit, the developing unit being provided rotatable relative to the photoconductor unit, and a link unit to allow a charging roller of the photoconductor unit to come into contact with or be separated from a photoconductor while in linkage with rotation of the developing unit.

20 Claims, 9 Drawing Sheets

PROCESS CARTRIDGE AND IMAGE FORMING APPARATUS HAVING THE SAME

CROSS-REFERENCE TO RELATED APPLICATIONS

This application claims the benefit of Korean Patent Application No. 2011-0001294, filed on Jan. 6, 2011 in the Korean Intellectual Property Office, the disclosure of which is incorporated herein by reference.

BACKGROUND

1. Field

Embodiments relate to an image forming apparatus having an improved configuration to allow a charging roller to come into contact with or be separated from a photoconductor.

2. Description of the Related Art

Image forming apparatuses include copiers, laser printers, facsimiles, etc. In operation of an image forming apparatus, a photoconductor (image carrier), which has been charged by a charging device, is selectively exposed to light such that an electrostatic latent image is formed on the photoconductor and then, a developing device develops the electrostatic latent image into a toner image. As the toner image is transferred to printer paper, formation of the image is completed. Toner remaining on the photoconductor is removed by a cleaning device.

The photoconductor, charging device, developing device, cleaning device, etc. are installed in a cartridge container to constitute an integrated process cartridge. The process cartridge is separably coupled to a body frame of the image forming apparatus. A user performs a maintenance function of the image forming apparatus by installing or separating the process cartridge.

SUMMARY

It is one aspect to provide a process cartridge to simply separate a charging roller from a photoconductor and an image forming apparatus having the same.

Additional aspects will be set forth in part in the description which follows and, in part, will be obvious from the description, or may be learned by practice of the invention.

In accordance with one aspect, a process cartridge may include a photoconductor unit including a photoconductor, a charging roller to charge a surface of the photoconductor, a developing unit to feed a developer to the photoconductor, the developing unit being rotatable relative to the photoconductor unit, and a link unit to cause the charging roller to come into contact with or be separated from the photoconductor while in linkage with rotation of the developing unit.

The link unit may include a link member provided at the developing unit to extend toward the photoconductor unit so as to interfere with the charging roller.

The link member may include an accommodation region to accommodate a shaft part of the charging roller.

The accommodation region may take the form of an elongated hole having a greater diameter than that of the shaft part of the charging roller.

The link unit may include a first link member rotatably provided at the photoconductor unit, and a second link member provided at the developing unit so as to interfere with the first link member, and at least a part of the first link member may be positioned to interfere with the charging roller.

The at least a part of the first link member may include an accommodation region to accommodate a shaft part of the charging roller.

The accommodation region may take the form of an elongated hole having a greater diameter than that of the shaft part of the charging roller.

The process cartridge may further include a charging roller pressure unit to allow the charging roller to be elastically supported on the photoconductor.

The charging roller pressure unit may include a pressure body to support a shaft part of the charging roller, a first elastic member to apply elastic force to the pressure body so as to push the pressure body toward the photoconductor, and a guide portion to guide movement of the pressure body.

The developing unit may include a developing roller to come into contact with or be separated from the photoconductor via rotation of the developing unit.

The process cartridge may further include a developing roller pressure unit to allow the developing roller to come into contact with the photoconductor.

The developing roller pressure unit may include a second elastic member, one end of which is secured to the photoconductor unit and the other end of which is secured to the developing unit, the second elastic member serving to allow the developing unit to be rotated relative to the photoconductor unit.

The developing unit may be hinged to the photoconductor unit.

The process cartridge may further include a spacer inserted between the photoconductor unit and the developing unit to keep the developing roller and the charging roller spaced apart from the photoconductor.

In accordance with another aspect, an image forming apparatus may include a main body, a photoconductor unit provided in the main body, a developing unit provided rotatable relative to the photoconductor unit, and a link unit to interfere with at least a part of the photoconductor unit while in linkage with rotation of the developing unit, wherein the photoconductor unit may include a photoconductor and a charging roller provided at one side of the photoconductor, and wherein the link unit may cause the charging roller to come into contact with or be separated from the photoconductor.

The link unit may include at least one link member to interfere with the charging roller.

The developing unit may include a developing roller to come into contact with or be separated from the photoconductor via rotation of the developing unit.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
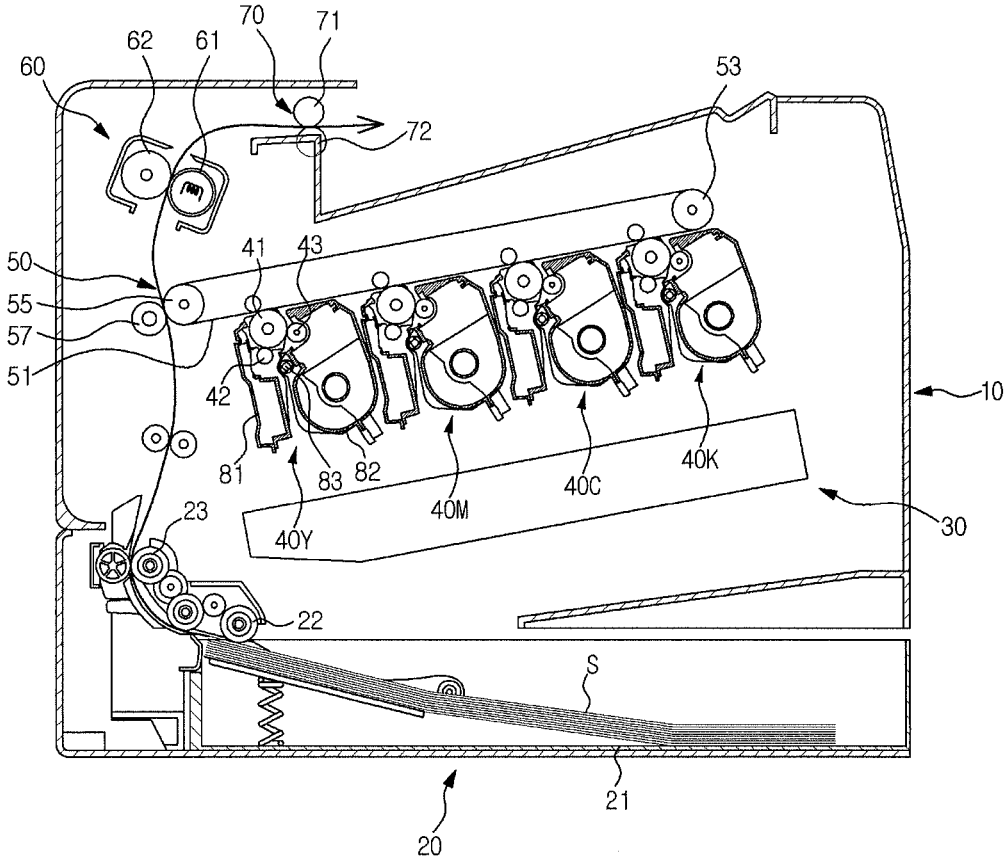
FIG. 1 is a view illustrating an interior configuration of an image forming apparatus according to an embodiment.

Reference will now be made in detail to an image forming apparatus according to one or more embodiments, examples of which are illustrated in the accompanying drawings, wherein like reference numerals refer to like elements throughout.

FIG. 1 is a side sectional view illustrating an interior configuration of the image forming apparatus according to one embodiment.

As illustrated in FIG. 1, the image forming apparatus may include a main body 10, a printing medium feeding unit 20, a light scanning unit 30, process cartridges 40, a transfer unit 50, a fusing unit 60, and a printing medium discharge unit 70.

The main body 10 may support a variety of elements installed therein. A cover member 11 (see FIG. 7) may be provided to open or close a part of the main body 10. This may allow a user to access the interior of the main body 10 through the cover member 11 to install or separate interior elements, such as the process cartridges 40.

The printing medium feeding unit 20 may include a cassette 21 in which printing media S is stored, a pickup roller 22 to pick up the printing media S stored in the cassette 21 sheet by sheet, and a delivery roller 23 to move the picked-up printing media S toward the transfer unit 50.

The light scanning unit 30 is located below the process cartridges 40 and may radiate light corresponding to image information to the photoconductor 41, forming an electrostatic latent image on a surface of the photoconductor 41.

The process cartridges 40 of the present embodiment may include a plurality of process cartridges 40Y, 40M, 40C and 40K to accommodate different color developers, e.g., yellow (Y), magenta (M), cyan (C) and black (K) developers.

Each process cartridge 40 may include the photoconductor 41, a charging roller 42, a developing roller 43, and a feed roller (not shown). The electrostatic latent image may be formed on the surface of the photoconductor 41 by the light scanning unit 30. The charging roller 42 may charge the photoconductor 41 with a predetermined electric potential. The feed roller (not shown) may feed the developer to the developing roller 43, and the developing roller 43 may attach the developer to the surface of the photoconductor 41 on which the electrostatic latent image has been formed, so as to form a visible image.

The transfer unit 50 may include a transfer belt 51 to circulate while in contact with the photoconductor 41 of each process cartridge 40, a drive roller 53 to drive the transfer belt 51, a tension roller 55 to apply constant tension to the transfer belt 51, and a transfer roller 57 to transfer the visible image developed on the photoconductor 41 of each process cartridge 40 to the printing medium S.

The fusing unit 60 may include a heating roller 61 having a heat source and a pressure roller 62 arranged to face the heating roller 61. When the printing medium passes between the heating roller 61 and the pressure roller 62, the image may be fixed to the printing medium by heat transferred from the heating roller 61 and pressure applied between the heating roller 61 and the pressure roller 62.

The printing medium discharge unit 70 may include a plurality of paper discharge rollers 71 and 72 to discharge the printing medium having passed through the fusing unit 60 to the outside of the main body 10.

Figure 2:
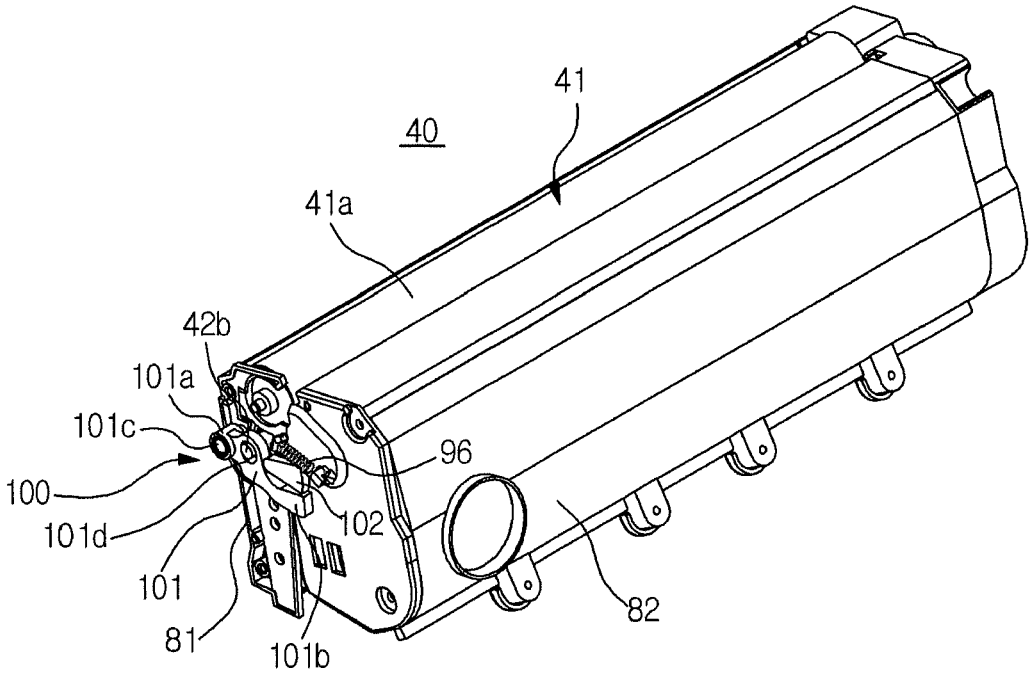
FIG. 2 is a view illustrating a lateral coupling configuration of a process cartridge according to one embodiment.
Figure 3:
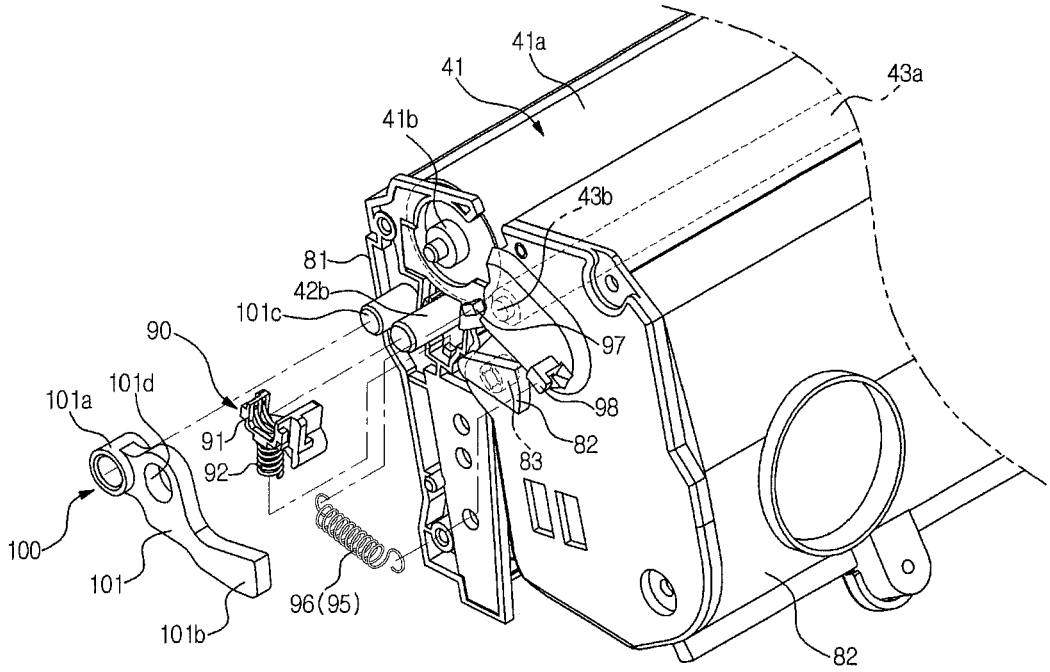
FIG. 3 is a view illustrating a partially exploded lateral configuration of the process cartridge according to one embodiment.

FIG. 2 is a view illustrating a lateral coupling configuration of the process cartridge according to one embodiment, and FIG. 3 is a view illustrating a partially exploded lateral configuration of the process cartridge according to one embodiment.

As illustrated in FIGS. 1 to 5, the process cartridges 40 may include a photoconductor unit 81, a developing unit 82, a charging roller pressure unit 90, a developing roller pressure unit 95, and a link unit 100.

The photoconductor unit 81 and the developing unit 82 may be hinged to each other. The developing unit 82 may be pivotally rotatable clockwise or counterclockwise relative to the photoconductor unit 81 about a hinge shaft 83. The developing roller 43 may be moved away from the photoconductor 41 when the developing unit 82 is pivotally rotated clockwise, and may come into contact with the photoconductor 41 when the developing unit 82 is pivotally rotated counterclockwise.

The photoconductor unit 81 may rotatably support the photoconductor 41. The photoconductor 41 may include a drum part 41*a* and a shaft part 41*b* protruding from either side of the drum part 41*a*. The shaft part 41*b* of the photoconductor 41 may be rotatably supported at fixed positions of the photoconductor unit 81.

The photoconductor unit 81 may also rotatably support the charging roller 42 below the photoconductor 41. The charging roller 42 may include a roller part 42*a* to come into contact with the photoconductor 41 and a shaft part 42*b* protruding from either side of the roller part 42*a*. The shaft part 42*b* of the charging roller 42 may be movably installed to the photoconductor unit 81. Specifically, the shaft part 42*b* of the charging roller 42 may be rotatably supported by a pressure body 91, and the pressure body 91 may be reciprocally movably coupled to a guide portion 81*a* of the photoconductor unit 81.

The charging roller pressure unit 90 may serve to push the charging roller 42 toward the photoconductor 41 such that the charging roller 42 comes into contact with the photoconductor 41. The charging roller pressure unit 90 may include the pressure body 91, a first elastic member 92, and the guide portion 81*a*. The first elastic member 92 may elastically support the pressure body 91. The first elastic member 92 may push the pressure body 91 upward, causing the pressure body 91 to move upward along the guide portion 81*a*. Thus, the charging roller 42 supported on the pressure body 91 may be moved, along with the pressure body 91, upward on the guide portion 81*a* until the charging roller 42 comes into contact with the photoconductor 41. The charging roller 42 may be elastically supported at an appropriate pressure on the photoconductor 41 by the first elastic member 92.

The photoconductor unit 81 may be provided with a cleaning member (not shown) to clean the developer remaining after the developer image is transferred from the photoconductor 41. The developer removed by the cleaning member may be stored in a waste developer reservoir (not shown).

The developing unit 82 may rotatably support the developing roller 43. The developing roller 43 may include a roller part 43*a* and a shaft part 43*b* protruding from either side of the roller part 43*a*. The shaft part 43*b* of the developing roller 43 may be rotatably supported in the developing unit 82.

The developing roller pressure unit 95 may push the developing roller 43 toward the photoconductor 41 such that the developing roller 43 comes into contact with the photoconductor 41. The developing roller pressure unit 95 may include a second elastic member 96, a first fixing protrusion 97, and a second fixing protrusion 98. The first fixing protrusion 97 may protrude from the photoconductor unit 81, one end of the second elastic member 96 being secured to the first fixing protrusion 97. The second fixing protrusion 98 may protrude from the developing unit 82, the other end of the second elastic member 96 being secured to the second fixing protrusion 98. The second elastic member 96 may act to rotate the developing unit 82 counterclockwise about the hinge shaft 83, causing the developing roller 43 to come into contact with the photoconductor 41. The developing roller 43 may be elastically supported at an appropriate pressure on the photoconductor 41 by the second elastic member 96.

The developing unit 82 may be provided with a developer reservoir (not shown) in which the developer may be stored. The developer may be fed to the developing roller 43 by the feed roller (not shown).

The link unit 100 may include a first link member 101 and a second link member 102. The link unit 100 may allow the charging roller 42 to come into contact with or be separated from the photoconductor 41 while in linkage with the developing unit 82.

The first link member 101 may have a first end 101*a* pivotally rotatably installed to the photoconductor unit 81 and a second end 101*b* extending toward the developing unit 82. Thus, the first end 101*a* of the first link member 101 may be pivotally rotatable clockwise or counterclockwise about a pivoting shaft 101*c*. The first link member 101 may be provided at a middle position thereof with an accommodation region 101*d* into which the shaft part 42*b* of the charging roller 42 may be inserted. The accommodation region 101*d* may take the form of an elongated hole having a greater diameter than a diameter of the shaft part 42*b*.

The second link member 102 may be secured to the developing unit 82 to protrude from the developing unit 82. Thus, the second link member 102 may be pivotally rotatable clockwise or counterclockwise about the hinge shaft 83 along with the developing unit 82. In this case, since the second link member 102 may be positioned to interfere with the first link member 101, the second link member 102 may push the first link member 101 when rotated clockwise. When the second link member 102 is rotated clockwise, the first link member 101 may also be rotated clockwise.

Hereinafter, operation of the image forming apparatus according to the embodiment will be described in detail.

Figure 4:
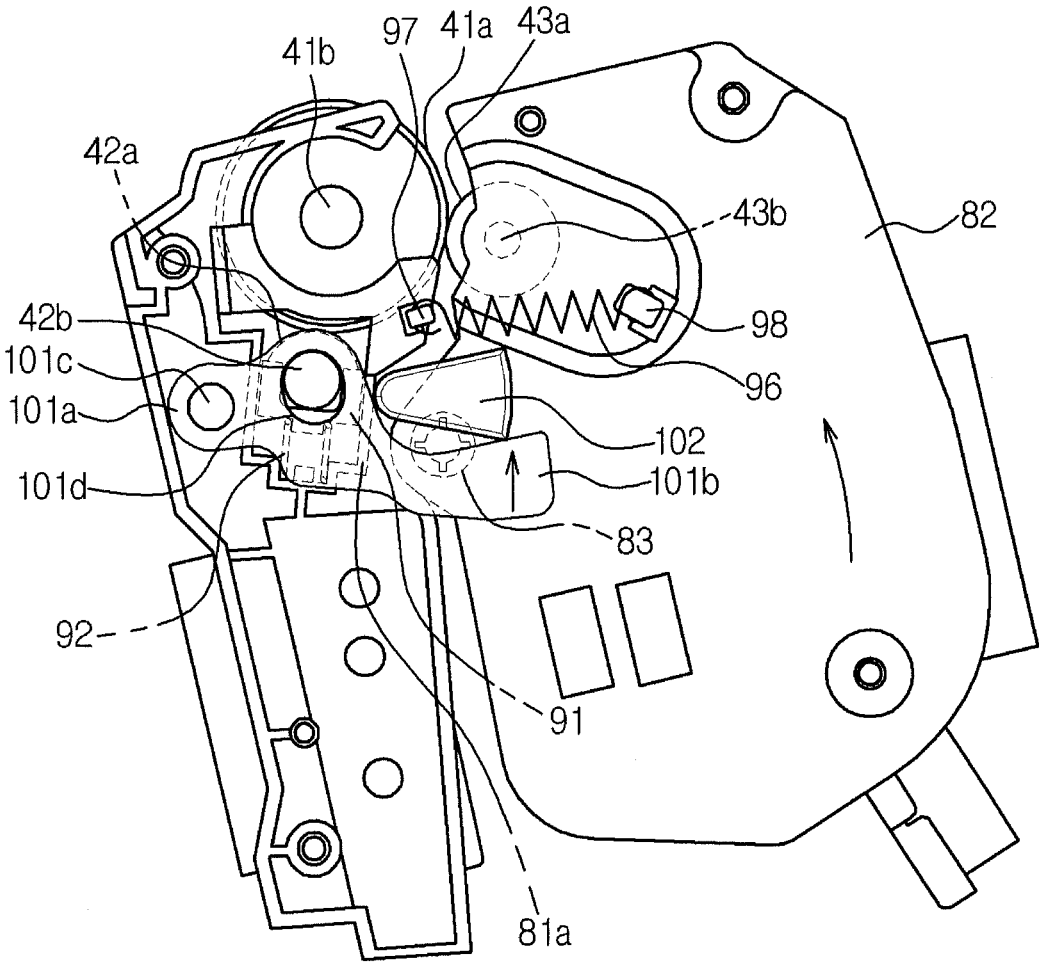
FIG. 4 is a view illustrating a state in which a charging roller comes into contact with a photoconductor according to one embodiment.
Figure 5:
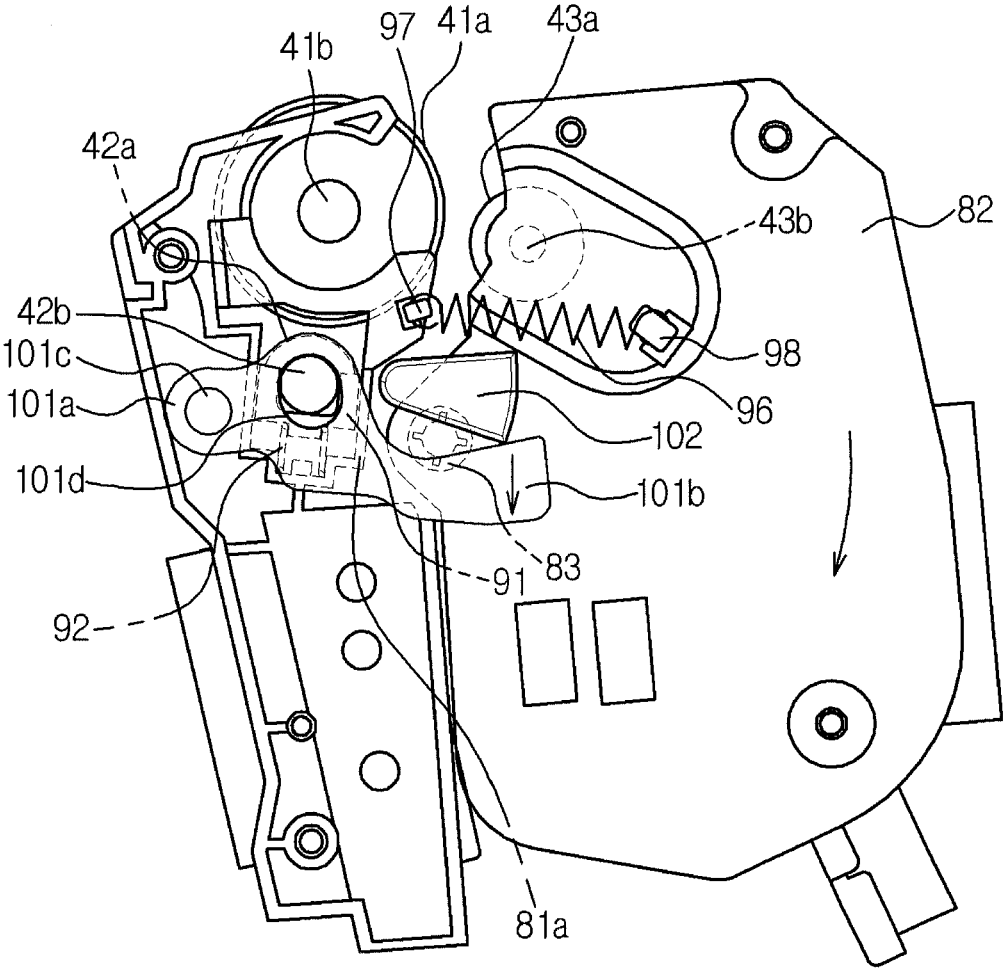
FIG. 5 is a view illustrating a state in which the charging roller is spaced apart from the photoconductor according to one embodiment.
Figure 6:
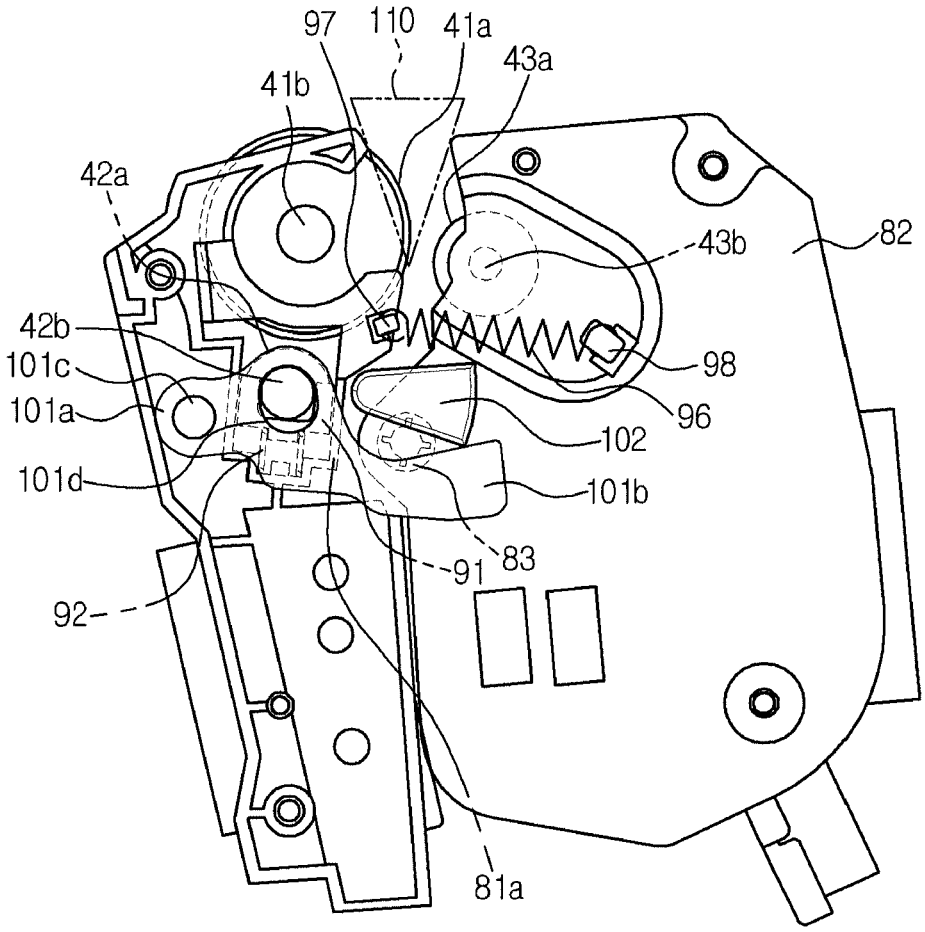
FIG. 6 is a view illustrating a coupled state of a spacer according to one embodiment.

FIG. 4 is a view illustrating a state in which the charging roller comes into contact with the photoconductor according to one embodiment, FIG. 5 is a view illustrating a state in which the charging roller is spaced apart from the photoconductor according to one embodiment, and FIG. 6 is a view illustrating a coupled state of a spacer according to one embodiment.

As illustrated in FIG. 4, the developing unit 82 may be rotated counterclockwise about the hinge shaft 83 by the second elastic member 96, causing the developing roller 43 to come into contact with the photoconductor 41. The second link member 102 may also be rotated counterclockwise along with the developing unit 82, thereby being separated from the first link member 101. As the pressure body 91 is moved upward along the guide portion 81*a* by the first elastic member 92, the charging roller 42 may also be moved upward to come into contact with the photoconductor 41. In this case, since the shaft part 42*b* of the charging roller 42 is inserted into the accommodation region 101*d* of the first link member 101, the first link member 101 may be rotated counterclockwise about the pivoting shaft 101*c* as the charging roller 42 is moved upward.

On the contrary, as illustrated in FIG. 5, if a user applies greater force than elastic force of the second elastic member 96 so as to rotate the developing unit 82 clockwise about the hinge shaft 83, the developing roller 43 may be separated from the photoconductor 41 and simultaneously, the second link member 102 may be rotated clockwise along with the developing unit 82. As the second link member 102 pushes the second end 101*b* of the first link member 101, the first link member 101 may be rotated clockwise about the pivoting shaft 101*c*. The first link member 101, into the accommodation region 101*d* of which the shaft part 42*b* of the charging roller 42 may be inserted, may cause the charging roller 42 and the pressure body 91 to move downward along the guide portion 81*a*. Thereby, the charging roller 42 may be separated from the photoconductor 41.

Thereafter, as illustrated in FIG. 6, the user may insert a spacer 110 between the photoconductor unit 81 and the developing unit 82 to maintain the developing roller 43 at a distance from the photoconductor 41 and the charging roller 42 at a distance from the photoconductor 41. If a process cartridge 40 is shipped from a manufacturer with the spacer 110 inserted therein as illustrated in FIG. 6, the developing roller 43 and the charging roller 42 are maintained at a distance from the photoconductor 41. This may prevent mechanical/chemical deformation encountered when the developing roller 43 and the charging roller 42 come into contact with the photoconductor 41.

Figure 7:
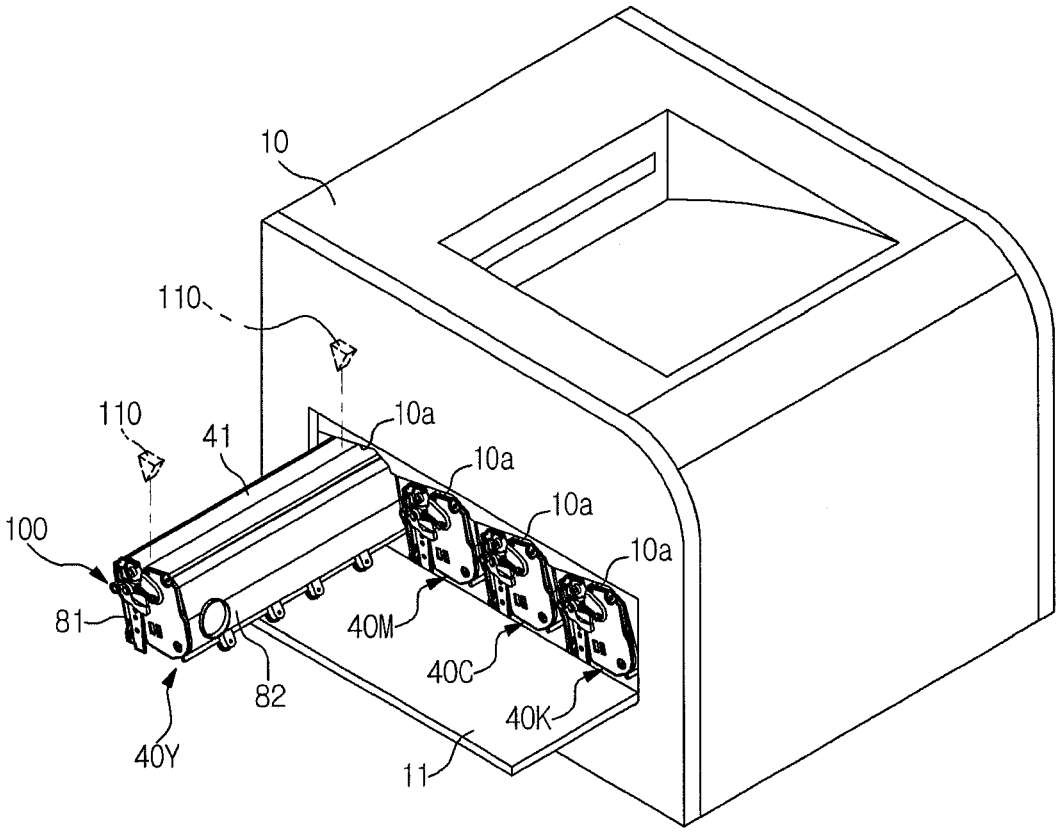
FIG. 7 is a view illustrating a state in which the process cartridge according to one embodiment is mounted to a main body.

FIG. 7 is a view illustrating a state in which the process cartridge according to one embodiment is mounted in the main body.

As illustrated in FIGS. 1 to 7, to mount a process cartridge 40 to the main body 10, the user first needs to remove the spacer 110. As soon as the spacer 110 is removed, as illustrated in FIG. 4, the developing unit 82 may be rotated counterclockwise about the hinge shaft 83 by the second elastic member 96, causing the developing roller 43 to come into contact with the photoconductor 41. The second link member 102 may also be rotated along with the developing unit 82, thereby being separated from the first link member 101. The pressure body 91 and the charging roller 42 may be moved upward along the guide portion 81*a* by the first elastic member 92 until the charging roller 42 comes into contact with the photoconductor 41. In this case, since the shaft part 42*b* of the charging roller 42 is inserted into the accommodation region 101*d* of the first link member 101, the first link member 101 may be rotated counterclockwise about the pivoting shaft 101*c* as the charging roller 42 is moved upward.

If a process cartridge 40 reaches the state illustrated in FIG. 4, the outer contour of the process cartridge 40 may correspond to the contour of a mounting region 10*a* of the main body 10. In this case, the process cartridge 40 may be easily inserted into the mounting region 10*a* of the main body 10. If the spacer 110 is not removed, i.e. if the process cartridge 40 reaches the state illustrated in FIG. 6, the outer contour of the process cartridge 40 may not correspond to the contour of the mounting region 10*a* of the main body 10. Thus, in such a state, the process cartridge 40 could not be inserted into the mounting region 10*a* of the main body 10.

Figure 8:
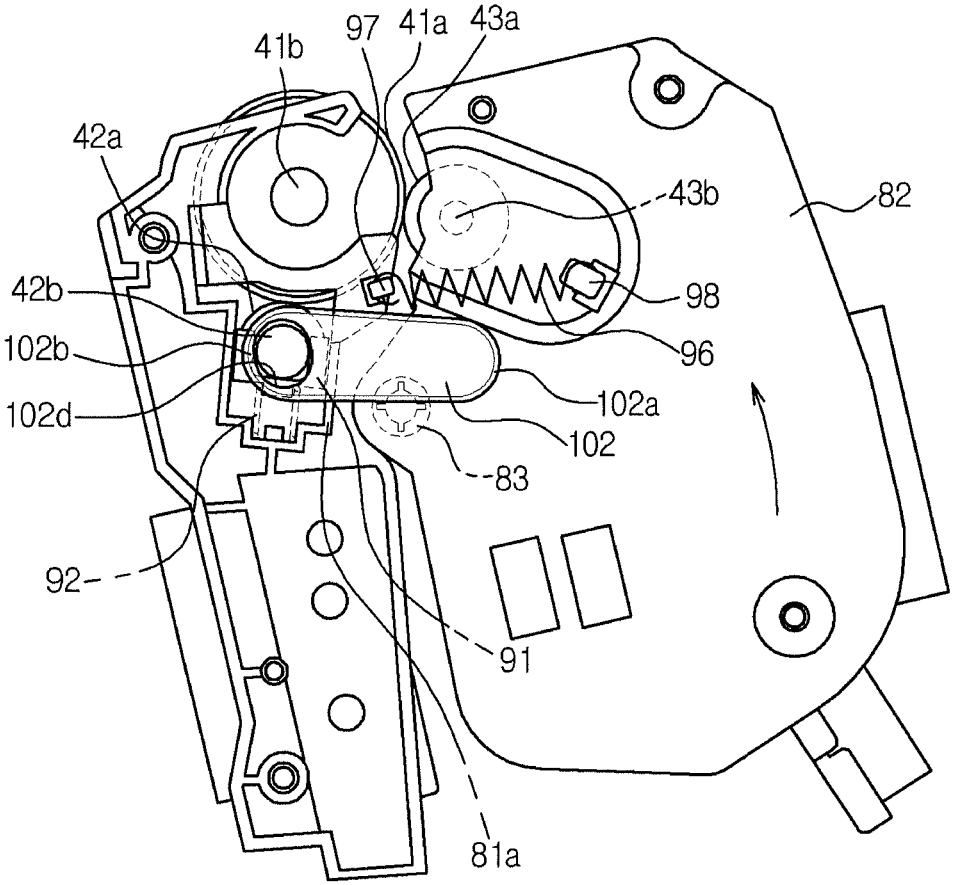
FIG. 8 is a view illustrating a state in which the charging roller comes into contact with the photoconductor according to another embodiment.
Figure 9:
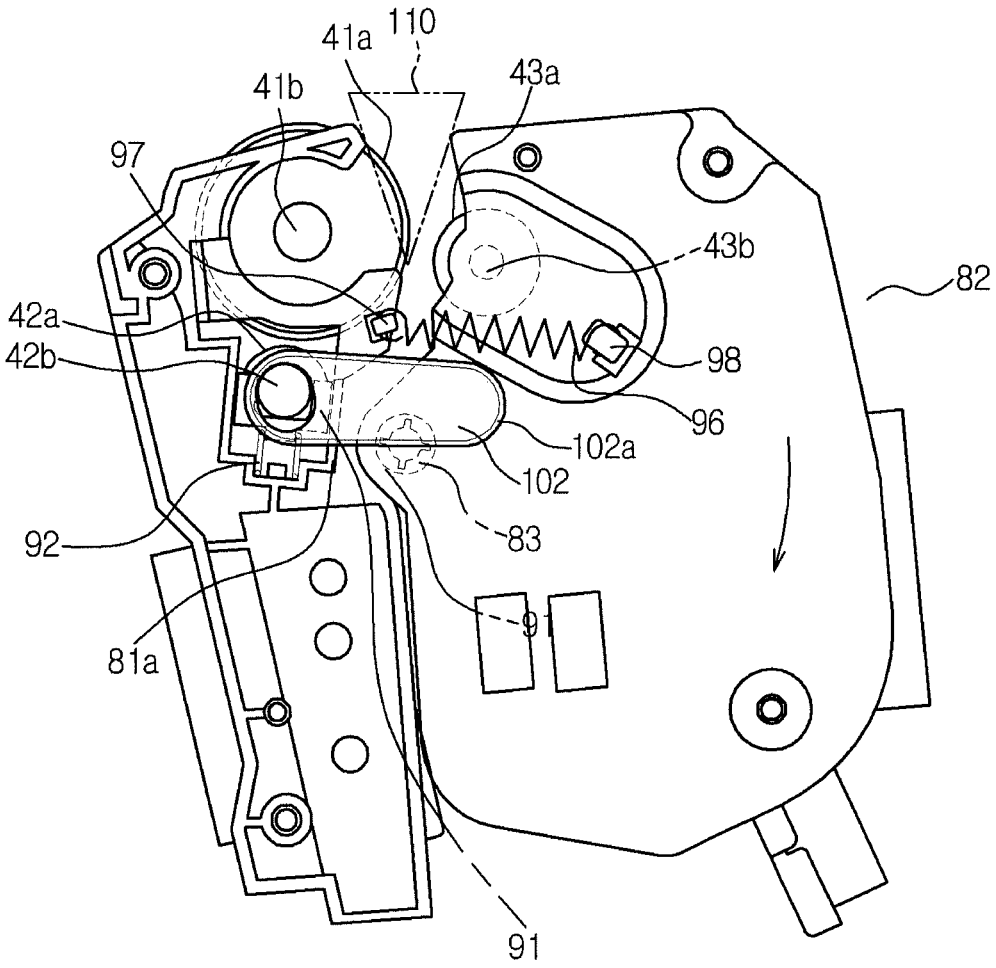
FIG. 9 is a view illustrating a state in which the charging roller is spaced apart from the photoconductor as compared to FIG. 8.

FIG. 8 is a view illustrating a state in which the charging roller comes into contact with the photoconductor according to another embodiment, and FIG. 9 is a view illustrating a state in which the charging roller is spaced apart from the photoconductor as compared to FIG. 8.

As illustrated in FIGS. 8 and 9, a process cartridge 40 may include the photoconductor unit 81, the developing unit 82, the charging roller pressure unit 90, the developing roller pressure unit 95, and the link unit 100. Hereinafter, a description of the same configuration as the above configuration will be omitted and differences will be mainly described.

The link unit 100 may allow the charging roller 42 to come into contact with or be separated from the photoconductor 41 while in linkage with the developing unit 82. The link unit 100 may include the link member 102. The link member 102*a* may have a first end 102 secured to the developing unit 82 and a second end 102*b* extending toward the photoconductor unit 81. The second end 102*b* of the link member 102 may be provided with an accommodation region 102*d* into which the shaft part 42*b* of the charging roller 42 may be inserted. The accommodation region 102*d* may take the form of an elongated hole having a greater diameter than a diameter of the shaft part 42*b*.

With the above described configuration, if the spacer 110 is removed, the developing unit 82 may be rotated counterclockwise about the hinge shaft 83 by the second elastic member 96, causing the developing roller 43 to come into contact with the photoconductor 41. In this case, as the second link member 102 is also rotated counterclockwise along with the developing unit 82, the accommodation region 102*d* of the link member 102 may be separated from the shaft part 42*b* of the charging roller 42. Thereby, the pressure body 91 may be moved upward along the guide portion 81*a* by the first elastic member 92 and simultaneously, the charging roller 42 may be moved upward along with the pressure body 91, thereby coming into contact with the photoconductor 41. On the contrary, if the spacer 110 is inserted between the photoconductor unit 81 and the developing unit 82, the developing unit 82 may be rotated clockwise about the hinge shaft 83, causing the developing roller 43 to be separated from the photoconductor 41. In this case, as the link member 102 is rotated clockwise along with the developing unit 82, the accommodation region 102*d* of the link member 102 may push the shaft part 42*b* of the charging roller 42 downward, causing the charging roller 42 to be separated from the photoconductor 41. The pressure body 91 may be moved downward along the guide portion 81*a*, acting to compress the first elastic member 92. As such, the spacer 110 may function to easily maintain the developing roller 43 and the charging roller 42 to be spaced apart from the photoconductor 41. The process cartridges 40 may be shipped and transported with the spacer 110 inserted therein.

When attempting to mount a process cartridge 40 into the main body 10, the user can insert the process cartridge 40 into the mounting region 10*a* of the main body 10 after removing the spacer 110.

As is apparent from the above description, one or more embodiments provide an image forming apparatus, which may prevent chemical or mechanical deformation of contact regions of a photoconductor and a charging roller and consequently, enhance image quality.

Further, preventing generation of scratches at the charging roller and the photoconductor may extend the lifespan of a developing unit.

Furthermore, as a result of allowing the charging roller to be moved to or away from the photoconductor while in linkage with a developing roller separation mechanism that has been previously adopted in the image forming apparatus, a compact image forming apparatus may be accomplished.

Although the embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A process cartridge comprising:

a photoconductor unit comprising a photoconductor and a charging roller to charge a surface of the photoconductor;

a developing unit to feed a developer to the photoconductor, the developing unit being provided rotatable relative to the photoconductor unit;

a link unit to cause the charging roller to come into contact with or be separated from the photoconductor according to a rotation of the developing unit; and a first link member provided at the developing unit.

2. The process cartridge according to claim 1, wherein the first link member extends toward the photoconductor unit so as to interfere with the charging roller.

3. The process cartridge according to claim 2, wherein the first link member comprises an accommodation region to accommodate a shaft part of the charging roller.

4. The process cartridge according to claim 3, wherein the accommodation region takes the form of an elongated hole having a greater diameter than that of the shaft part of the charging roller.

5. The process cartridge according to claim 1, wherein:

the link unit comprises:

a second link member rotatably provided at the photoconductor unit; and the first link member provided at the developing unit so as to interfere with the second link member; and at least a part of the second link member is positioned to interfere with the charging roller.

6. The process cartridge according to claim 5, wherein the at least a part of the first link member comprises an accommodation region to accommodate a shaft part of the charging roller.

7. The process cartridge according to claim 6, wherein the accommodation region takes the form of an elongated hole having a greater diameter than that of the shaft part of the charging roller.

8. The process cartridge according to claim 1, further comprising a charging roller pressure unit to allow the charging roller to be elastically supported on the photoconductor.

9. The process cartridge according to claim 8, wherein the charging roller pressure unit comprises:

a pressure body to support a shaft part of the charging roller;

a first elastic member to apply elastic force to the pressure body so as to push the pressure body toward the photoconductor; and a guide portion to guide movement of the pressure body.

10. The process cartridge according to claim 1, wherein the developing unit comprises a developing roller to come into contact with or be separated from the photoconductor via rotation of the developing unit.

11. The process cartridge according to claim 10, further comprising a developing roller pressure unit to allow the developing roller to come into contact with the photoconductor.

12. The process cartridge according to claim 11, wherein the developing roller pressure unit comprises a second elastic member, one end of which is secured to the photoconductor unit and the other end of which is secured to the developing unit, the second elastic member serving to allow the developing unit to be rotated relative to the photoconductor unit.

13. The process cartridge according to claim 1, wherein the developing unit is hinged to the photoconductor unit.

14. The process cartridge according to claim 1, further comprising a spacer inserted between the photoconductor unit and the developing unit to keep the developing roller and the charging roller spaced apart from the photoconductor.

15. An image forming apparatus comprising:

a main body;

a photoconductor unit provided in the main body;

a developing unit provided rotatable relative to the photoconductor unit;

a link unit to interfere with at least a part of the photoconductor unit while in linkage with rotation of the developing unit, the link unit; and a link member provided at the developing unit, wherein the photoconductor unit comprises a photoconductor and a charging roller provided at one side of the photoconductor, and wherein the link unit causes the charging roller to come into contact with or be separated from the photoconductor.

16. The image forming apparatus according to claim 15, wherein the link member extends toward the photoconductor unit so as to interfere with the charging roller.

17. The image forming apparatus according to claim 15, wherein the developing unit comprises a developing roller to come into contact with or be separated from the photoconductor via rotation of the developing unit.

18. A process cartridge comprising:

a photoconductor unit comprising a photoconductor and a charging roller to charge a surface of the photoconductor;

a developing unit to feed a developer to the photoconductor, the developing unit being provided rotatable relative to the photoconductor unit;

a first link member rotatably provided at the photoconductor unit, wherein at least a part of the first link member is positioned to cause the charging roller to come into contact with or be separated from the photoconductor according to a rotation of the developing unit;

a second link member provided at the developing unit so as to interfere with the first link member; and a charging roller pressure unit to allow the charging roller to be elastically supported on the photoconductor.

19. The process cartridge according to claim 18, further comprising a developing roller pressure unit to allow the developing roller to come into contact with the photoconductor.

20. The process cartridge according to claim 18, further comprising a spacer inserted between the photoconductor unit and the developing unit to keep the developing roller and the charging roller spaced apart from the photoconductor.

* * * * *